US007779508B2

(12) United States Patent
Hardesty

(10) Patent No.: US 7,779,508 B2
(45) Date of Patent: Aug. 24, 2010

(54) REFRIGERATOR DOOR CLOSER AND METHOD

(76) Inventor: Bryan A. Hardesty, 4646 E. Sunset Ave., Bloomington, IN (US) 47403

( * ) Notice: Subject to any disclaimer, the term of this patent is extended or adjusted under 35 U.S.C. 154(b) by 924 days.

(21) Appl. No.: 11/541,591

(22) Filed: Oct. 2, 2006

(65) Prior Publication Data

US 2008/0078052 A1 Apr. 3, 2008

(51) Int. Cl.
*E05F 1/08* (2006.01)

(52) U.S. Cl. ..... 16/80; 16/76; 16/50

(58) Field of Classification Search ..... 16/49, 16/50, 68, 54, 80, 72, 75, 76, 277, 286, 378, 16/375, 376

See application file for complete search history.

(56) References Cited

U.S. PATENT DOCUMENTS

| | | | | | |
|---|---|---|---|---|---|
| 59,082 | A | * | 10/1866 | Scheidler | 16/76 |
| 823,372 | A | * | 6/1906 | Stevens et al. | 16/49 |
| 1,088,483 | A | * | 2/1914 | Toussaint | 16/80 |
| 1,561,209 | A | * | 11/1925 | Bommer | 16/80 |
| 2,219,821 | A | * | 10/1940 | Schonitzer | 16/49 |
| 2,542,340 | A | * | 2/1951 | Mauraton | 16/381 |
| 2,651,074 | A | * | 9/1953 | Slopa et al. | 16/80 |
| 2,706,828 | A | * | 4/1955 | Spears | 16/274 |
| 3,452,387 | A | | 7/1969 | Jerila et al. | |
| 3,628,845 | A | | 12/1971 | Grimm | |
| 3,811,150 | A | * | 5/1974 | Chalmers | 16/352 |
| 4,215,449 | A | | 8/1980 | Loikitz | |
| 4,439,888 | A | * | 4/1984 | Merillat | 16/286 |
| 4,823,438 | A | * | 4/1989 | Roloff | 16/307 |
| 4,944,066 | A | | 7/1990 | Fayngersh et al. | |
| 5,138,743 | A | | 8/1992 | Hoffman | |
| 5,191,678 | A | * | 3/1993 | Firari | 16/305 |
| 5,251,402 | A | | 10/1993 | Richardson et al. | |
| 5,539,954 | A | * | 7/1996 | Ambar | 16/85 |
| 5,715,574 | A | * | 2/1998 | Schall | 16/301 |
| 5,988,709 | A | | 11/1999 | Lee et al. | |
| 6,658,694 | B2 | | 12/2003 | Wang | |
| 6,904,642 | B2 | | 6/2005 | West | |
| 2002/0007564 | A1 | | 1/2002 | Myers et al. | |
| 2004/0205930 | A1 | | 10/2004 | Huang | |

* cited by examiner

*Primary Examiner*—Robert J Sandy
*Assistant Examiner*—Michael Lee
(74) *Attorney, Agent, or Firm*—Liell & McNeil

(57) ABSTRACT

A door closer to adapt a storage device having a body and a swinging door for automatic closing includes a hinge having first and second hinge elements. Each of the hinge elements include a length dimension and a height dimension parallel the axis of the hinge and are configured to rotate about the axis. A panel is provided which is coupled with the second hinge element and has a length dimension greater than a length dimension of the first hinge element. The door closer is configured via a spring force of a biasing device to bias a swinging door of a storage device toward a closed position against the body of the storage device, at least in part via an interaction between one of the hinge elements and the door, and an interaction between the other of the hinge elements and the body via the panel.

11 Claims, 3 Drawing Sheets

REFRIGERATOR DOOR CLOSER AND METHOD

TECHNICAL FIELD

The present disclosure relates generally to apparatuses and methods for automatically closing swinging doors and the like, and relates more particularly to an automatic door closer adapted for retrofit mounting on the exterior of a refrigerator.

BACKGROUND

The desire for self-closing refrigerators led engineers many years ago to develop spring-biased mechanisms for biasing refrigerator doors inadvertently left open toward a closed position. Refrigerators equipped with self-closing doors can reduce energy loss due to heat exchange with ambient, and prolong the life of refrigerated foods. As is the case with many high tech features for home appliances, self-closing doors invariably increase the cost and complexity of refrigerators and are typically available only on higher-end models. In addition, the difficulty in placing the necessary components within the hinge mechanism of refrigerator doors alone, apart from expense, has led some manufactures to limit self-closing doors as a design option.

In an attempt to render some refrigerators capable of self-closing, the appliances are sometimes positioned on a slight incline such that the doors will have some tendency to return toward a closed position under the force of gravity. Aside from the aesthetic undesirability of such a strategy, various of the refrigerator components are designed to best operator in an upright manner, and tilting one's refrigerator from its intended orientation can actually increase wear on certain of the components or reduce efficiency. Despite the familiar drawbacks of leaving the door to the fridge open, many conventional refrigerators have no means to deal with this problem.

The present disclosure is directed to one or more of the problems or shortcomings set forth above.

SUMMARY OF THE DISCLOSURE

In one aspect, the present disclosure provides a door closer configured to adapt a storage device having a body and a swinging door for automatic closing. The door closer includes a hinge, including a body defining an axis, a first hinge element having at least one planar face and a second hinge element also having at least one planar face. Each of the hinge elements includes a length dimension and a height dimension parallel the axis, and are configured to rotate about the axis. A biasing device is coupled with each of the first and second hinge elements and configured to rotationally bias the first and second hinge elements in opposing directions about the axis, the biasing device having a spring force. A panel is provided which is coupled with the second hinge element and has a length dimension greater than a length dimension of the first hinge element. The door closer is configured via the spring force of the biasing device to bias a swinging door of a storage device toward a closed position against the body of the storage device when coupled to an exterior of the storage device, at least in part via an interaction between one of the hinge elements and the door, and an interaction between the other of the hinge elements and the body via the panel.

In another aspect, the present disclosure provides a kit for adapting a swinging door of a storage device for automatic closing. The kit includes a door closer having a hinge that includes a hinge body defining an axis, a first hinge element and a second hinge element each configured to move about the axis. The door closer further includes a biasing device configured to rotationally bias the first and second hinge elements in opposing directions about the axis and a panel coupled with one of the hinge elements which is configured to slidably interact with a body of the storage device. The kit further includes means for attaching one of the hinge elements to an exterior surface of a swinging door of a storage device, whereby the one of the hinge elements can interact with the door via the means for attaching and the other of the hinge elements can interact with the body of the storage device via the panel to bias the swinging door toward a closed position.

In still another aspect, the present disclosure provides a method of adapting a refrigerator for automatic door closing, the refrigerator having a swinging door and a body. The method includes biasing a first hinge element and a second hinge element of a hinge in opposing directions about an axis of the hinge with a biasing device having a biasing force. The method further includes biasing the swinging door toward a closed position against the body via the biasing force of the biasing device, including mounting the first hinge element to an exterior of the swinging door, and positioning a panel coupled with the second hinge element adjacent an exterior of the body to slidably interact therewith.

DETAILED DESCRIPTION

Figure 1:
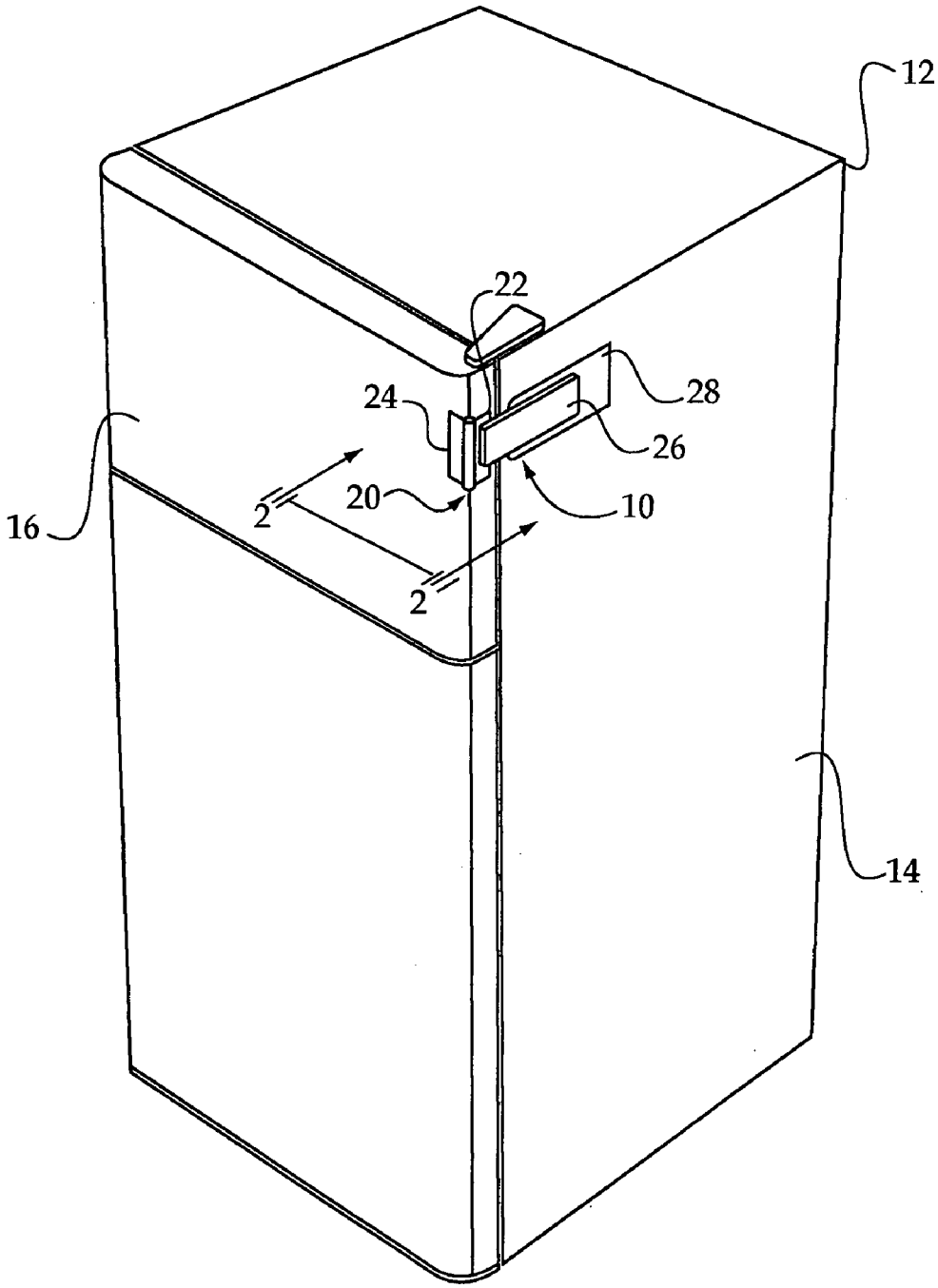
FIG. 1 is a perspective view of a refrigerator adapted for automatic door closing via a door closer according to one embodiment.

Referring to FIG. 1, there is shown a refrigerator 12 having a door closer 10 coupled with a door 16 and configured to bias door 16 toward a closed position against a body 14. Refrigerator 12 is shown in the context of a conventional refrigerator having an upper freezer section, and a relatively larger lower fresh food section. Door closer 16 provides a retrofit attachment for adapting door 16 for automatic closing, as further described herein. Door closer 10 is shown coupled with door 16, but might alternatively be mounted to provide automatic closing for the lower door (not numbered) of refrigerator 12. In other embodiments, door closers according to the present disclosure might be used for each of the doors of a refrigerator. For relatively heavier doors, two door closers might be used for a single door. It should further be appreciated that a wide variety of applications for the present disclosure are possible, and the methods and apparatuses described herein are not limited to use with refrigerators, as many types of storage devices having a swinging door and body could be amenable to adaptation for automatic closing via the present strategy. As alluded to above, however, retrofitting refrigerators for automatic closing is contemplated to be a primary application of the teachings of the present disclosure.

Figure 2:
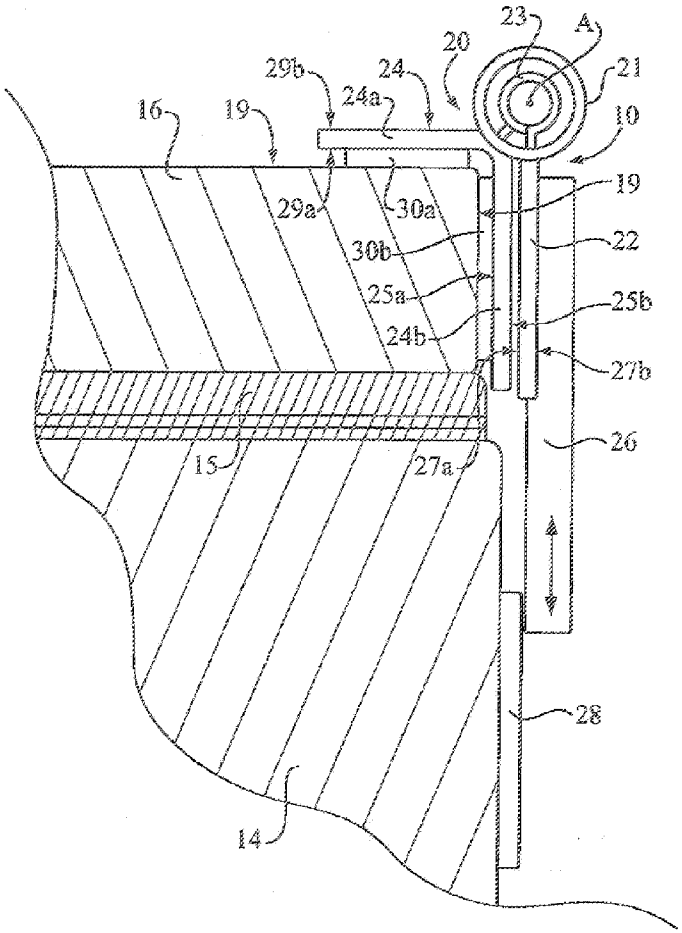
FIG. 2 is a partially sectioned bottom view taken approximately along line 2-2 of FIG. 1, showing the refrigerator door in a closed position.

Referring also to FIG. 2, door closer 10 may comprise a hinge 20 having a hinge body 21 defining an axis A, and first and second hinge elements 24 and 22 configured to rotate about axis A. Hinge elements 24 and 22 could be separate components from body 21, or they might each make up a portion of body 21. A biasing device, such as a coil spring 23 may be disposed internally of hinge body 21 and configured to bias hinge elements 22 and 24 in opposing directions about axis A. Hinge body 21 is shown open ended in FIG. 2 to illustrate spring 23, however, spring 23 may be entirely enclosed by hinge body 21 in certain embodiments. Hinge 20 may comprise a self-closing hinge such as are well known to those familiar with various types of hardware. In other embodiments, however, an external biasing device such as a leaf spring or still another biasing device might be used.

First hinge element 24 may be configured to interact with door 16, and second hinge element 22 may be configured to interact with body 14, together biasing door 16 toward a closed position against body 14 via a spring force of spring 23. Interaction between first hinge element 24 and door 16 may be enabled by mounting first hinge element 24 to door 16 by a variety of means. In one embodiment, an adhesive material such as strips of adhesive tape 30*a* and 30*b*, e.g. double stick tape, may be used to affix first hinge element 24 to door 16. Other mounting means such as epoxies and the like or fasteners might alternatively be used. With first hinge element 24 thus mounted to door 16, the spring force of spring 23 can impart a tendency on hinge elements 24 and 22 to rotate toward one another, thus biasing door 16 toward a closed position against body 14. In the embodiment and viewpoint of FIG. 2, first hinge element 24 may be biased in a counter-clockwise direction whereas second hinge element 22 may be biased in a clockwise direction. Interaction between second hinge element 22 and body 14 may be enabled via a panel 26 coupled with second hinge element 22, panel 26 being configured to slidably interact with body 14 and extending across a gap between door 16 and body 14. The gap, typical to most refrigerators, will typically be closed/filled via a conventional magnetic cushioning strip 15. Panel 26 may thus serve as an extension of second hinge element 22 which will enable leverage from spring 23 to be simultaneously applied to body 14 and door 16.

Each of hinge elements 24 and 22 may include at least one planar face, for example, a plurality of planar faces. Second hinge element 22 may comprise a first, or inner planar face 27*a* and an opposite planar face 27*b*. While panel 26 and second hinge element 22 are shown as separate members, in other embodiments they might comprise a single part. Thus, the description herein of panel 26 and second hinge element 22 being coupled together should not be construed to require that distinct components be used. A separate panel 26 such as a wooden or elastomeric panel, however, coupled with second hinge element 22 via adhesive material or fasteners, will provide one practical implementation strategy.

In the embodiment shown in FIG. 2, second hinge element 22 may include a plate member, also identified via numeral 22. First hinge element 24 may include a first plate member 24*a* and a second plate member 24*b*, each having an inner planar face 29*a* and 25*a*, respectively, whereupon adhesive tape strips 30*a* and 30*b* are disposed, and an outer planar face 29*b* and 25*b*, respectively, disposed opposite planar faces 29*a* and 25*a*. Plate member 22 may include an inboard edge adjoining hinge body 21, and an outboard edge. Planar face 27*a* and planar face 27*b* may each extend from the inboard edge of plate member 22 to the outboard edge thereof. First and second plate members 24*a* and 24*b* may be oriented at a fixed perpendicular angle to one another, and may comprise a unitary piece, permitting them to each be mounted to exterior surfaces 19 of door 16, the exterior surfaces sharing a common edge. It may also be noted from FIG. 4 that first plate member 24*a*, second plate member 24*b* and plate member 22 are coupled with hinge body 21 at axially overlapping locations. Each of first plate member 24*a* and second plate member 24*b* includes an inboard edge adjoining hinge body 21 and an outboard edge which is opposite the corresponding inboard edge. Inner planar face 29*a* and inner planar face 25*a* may extend from the inboard edge of the corresponding plate member to the outboard edge of the corresponding plate member. Outer planar face 29*b* and outer planar face 25*b* may also extend from the inboard edge of the corresponding plate member to the outboard edge of the corresponding plate member. Inner planar face 29*a* and inner planar face 25*a* define an inner right angle and an outer right angle sharing a vertex which is parallel axis A. The inner right angle and the outer right angle are opposite angles, and axis A is located within the outer right angle.

Figure 4:
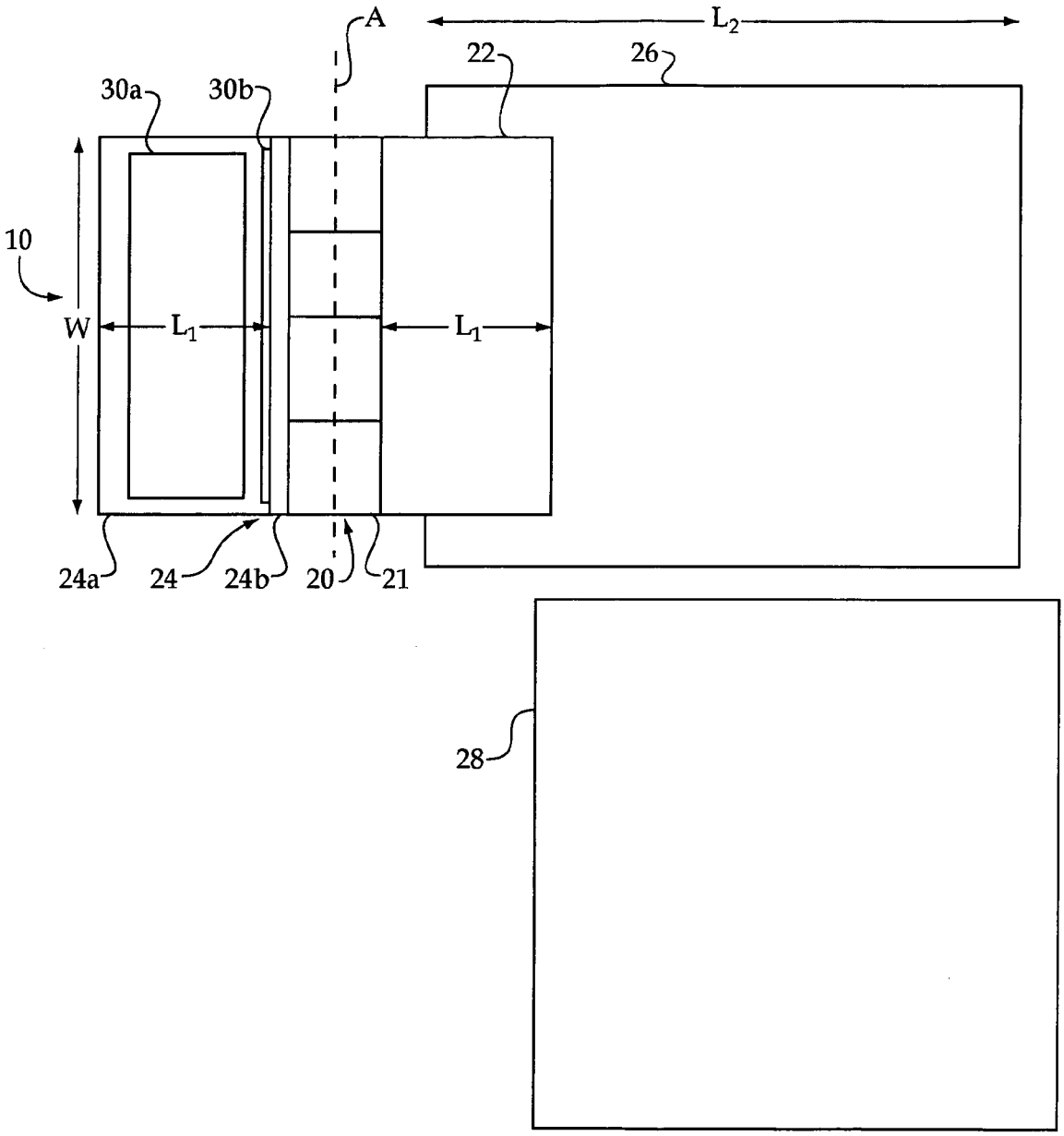
FIG. 4 is an elevational view of a door closer kit according to one embodiment.

Turning to FIG. 4, plate members 24*a*, 24*b* and 22 may all be substantially rectangular, each having a similar width dimension W oriented parallel axis A, and a similar length dimension $L_1$ oriented perpendicular width dimension W. In FIG. 4, hinge 20 is shown with hinge elements 24 and 22 spread apart from a biased configuration for illustrative purposes. The biasing force of spring 23 would tend to urge hinge elements 22 and 24 toward one another about axis A in directions out of the page in FIG. 4.

Panel 26 may also include a length dimension $L_2$ which will typically be greater than $L_1$. The relatively greater length of panel 26 will enable second hinge element 22 to interact with body 14 of refrigerator 12 across the gap between door 16 and body 14 filled by cushion 15 when door 16 is closed. In other words, as mentioned above, panel 26 may serve as an extension whereby second hinge element 22 can reach far enough to bear against body 14 to enable biasing of door 16 toward a closed position. The relative length of panel 26 may be varied to provide a relatively greater, or relatively lesser, leverage against body 14, as desired. A wear strip 28, which may be wider than panel 26, may be provided and may be attached to body 14 with adhesive material, for example, to protect body 14 from scratching by panel 26 as it slidably interacts therewith, further described below. Wear strip 28, or another suitable material might instead be applied to panel 26.

Door closer 10 may be provided as a kit for adapting a storage device such as a refrigerator for automatic closing. A kit according to the present disclosure may include certain of the components of door closer 10, including hinge 20 and its associated hinge elements 22 and 24, panel 26, and means for mounting one of hinge elements 24 and 22 to door 16, such as double stick tape or fasteners. In some embodiments, such a kit may also include wear strip 28. In still further embodiments, hinge 20 might have an adjustable biasing force, for example, via means for varying coiling of spring 23 to increase or decrease the relative biasing force thereof.

INDUSTRIAL APPLICABILITY

When it is desirable to adapt a refrigerator for automatic closing of one or more of its doors, a user may obtain a kit, as described herein. Where the kit includes a wear strip 28, wear strip 28 may be initially applied to an exterior of a refrigerator unit such as to body 14 of refrigerator 12. Next, the user may apply strips of double stick tape, 30*a* and/or 30*b*, to either of first hinge element 24 or surfaces 19 of a refrigerator door 16, then mount hinge element 24 to door 16 via tape strips 30*a* and 30*b*. It should be appreciated that although first hinge element 24 is illustrated having two separate plate members

24*a* and 24*b*, only a single plate member might be used. In particular, designs are contemplated wherein only plate member 24*b* is used.

Figure 3:
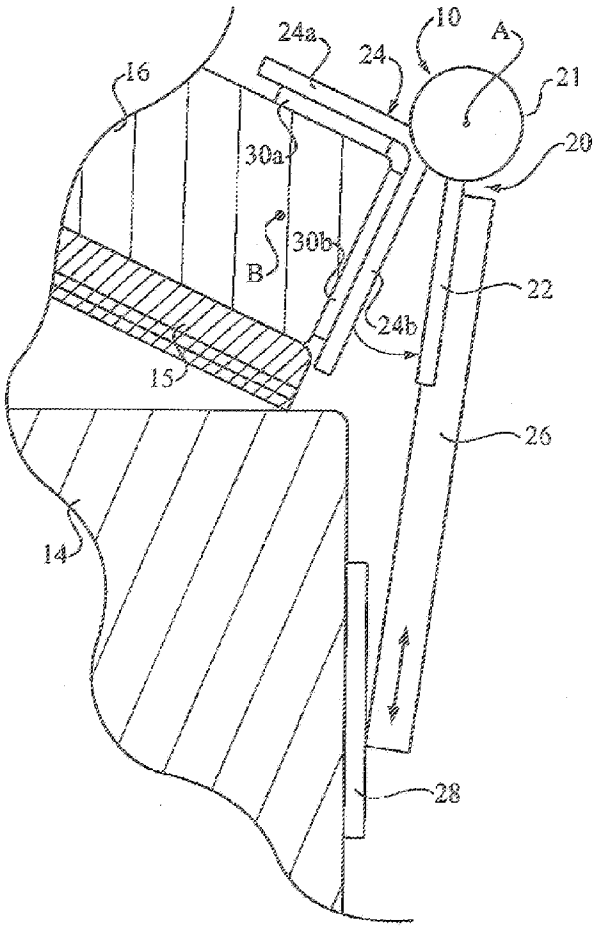
FIG. 3 is a partially sectioned bottom view also taken approximately along line 2-2 of FIG. 1, showing the refrigerator door in an open position.

Referring also to FIG. 3, there is shown door 16 in an open position relative to body 14. When door 16 is opened to access a storage compartment(s) of refrigerator 12, hinge elements 24 and 22 will be urged to rotate opposite to the biasing force of spring 23. As door 16 is opened, it will typically swing outwardly about an axis B. Rotation of door 16 about axis B will in turn induce rotation of hinge 20 about axis B. A relatively small change in position of axis A as door 16 is opened will tend to cause panel 26 to slide against wear strip 28. Hence, the interaction of second hinge element 22 with body 14 of refrigerator 12 will generally be a sliding interaction via panel 26. The change in position of axis A may also tend to move panel 26 towards an angle relative to body 14 as shown in FIG. 3, although the angle is slightly exaggerated for illustrative purposes in FIG. 3. It should be appreciated, however, that alternative embodiments are contemplated wherein panel 26 is slidably coupled with hinge element 22 and rigidly fixed/mounted to body 14 rather than slidably interacting therewith. Other features of door closer 16 might also be configured such that panel 26 has a different motion, sliding, pivoting action, etc. than that of the embodiments described herein.

When a user no longer holds door 16 open, the biasing force of spring 23 will impart a tendency for door 16 to return toward a closed position, against body 14 and cushioned and sealed via cushion 15. As such, first hinge element 24 will interact with door 16 via tape strips 30*a* and 30*b*, and second hinge element 22 will slidably interact with body 14 via panel 26, biasing door 16 toward a closed position. Thenceforth, door 16 will tend to return to its closed position, approximately as shown in FIG. 2.

The present description is for illustrative purposes only, and should not be construed to narrow the breadth of the present disclosure in any way. Thus, those skilled in the art will appreciate that various modifications might be made to the presently disclosed embodiments without departing from the full and fair scope of the present disclosure. The components of door closer 16 disclosed herein are not limited with respect to materials, configuration and operation, except as specifically set forth. Thus, while metallic plate members are contemplated to be useful in constructing hinge elements 22 and 24, other materials might be used. Panel 26 might be wood, plastic, metallic, or yet another material, so long as it has sufficient rigidity to provide for interaction with body 14 as described herein. Similarly, a variety of shapes, surface ornamentation and other features might be applied to the components of door closer 10 without departing from the scope of the present disclosure. Still further embodiments are contemplated wherein a housing is provided, serving as a decorative cover to obscure the components of door closer 10. Other aspects, features and advantages will be apparent upon an examination of the attached drawings and appended claims.

I claim:

1. A door closer configured to adapt a storage device having a body and a swinging door for automatic closing comprising:

a hinge including, a cylindrical body defining an axis, a first hinge element having at least one planar face and a second hinge element having at least one planar face, each of said hinge elements having a length dimension and a height dimension parallel said axis and being configured to rotate about said axis;

the first hinge element including a first plate member and a second plate member, the first plate member and the second plate member being coupled with the body at axially overlapping locations and each including an inboard edge adjoining the body, and an outboard edge;

the at least one planar face of each one of the first plate member and the second plate member including an outer planar face extending from the corresponding inboard edge to the corresponding outboard edge, and an inner planar face extending from the corresponding inboard edge to the corresponding outboard edge;

the inner planar face of the first plate member and the inner planar face of the second plate member defining an inner right angle and an outer right angle sharing a vertex which is parallel the axis, the inner right angle and the outer right angle being opposite angles, and the axis being located within the outer right angle;

the second hinge element including a third plate member, the third plate member being coupled with the body at a location axially overlapping with the first plate member and the second plate member, and having an inboard edge adjoining the body and an outboard edge, the third plate member further including an inner planar face extending from the corresponding inboard edge to the corresponding outboard edge, and an outer planar face extending from the corresponding inboard edge to the corresponding outboard edge;

a biasing device coupled with each of said first and second hinge elements and configured to rotationally bias said first and second hinge elements in opposing directions about said axis, said biasing device having a spring force; and a panel coupled with said second hinge element and having a length dimension greater than a length dimension of said first hinge element;

wherein said door closer is configured via the spring force of said biasing device to bias a swinging door of a storage device toward a closed position against a body of the storage device when coupled to an exterior of the storage device, at least in part via an interaction between one of said hinge elements and the door, and an interaction between the other of said hinge elements and the body via said panel.

2. The door closer of claim 1 wherein said biasing device comprises a spring disposed within said hinge body.

3. The door closer of claim 2 wherein the inner face of each of the first plate member and the second plate member includes a planar face, wherein said second plate member having a fixed perpendicular orientation relative to said first plate member, and wherein said first and second plate members are configured to mount to first and second outer surfaces of a swinging door of a storage device sharing a common edge.

4. The door closer of claim 3 further comprising an adhesive material disposed on the inner faces of the first hinge element for enabling interaction between said first hinge element and said door.

5. The door closer of claim 4 wherein said adhesive comprises strips of adhesive tape.

6. A kit for adapting a swinging door of a storage device for automatic closing comprising:

a door closer having a hinge that includes a cylindrical hinge body defining an axis, a first hinge element and a second hinge element each configured to move about said axis, said door closer further including a biasing device configured to rotationally bias said first and second hinge elements in opposing directions about said axis and a panel coupled with one of said hinge elements which is configured to slidably interact with a body of the storage device;

the first hinge element including a first plate member and a second plate member, the first plate member and the second plate member being coupled with the cylindrical hinge body at axially overlapping locations and each including an inboard edge adjoining the cylindrical hinge body, and an outboard edge;

each of the first plate member and the second plate member further including an inner planar face extending from the corresponding inboard edge to the corresponding outboard edge, and an outer planar face extending from the corresponding inboard edge to the corresponding outboard edge;

the inner planar face of the first plate member and the inner planar face of the second plate member defining an inner right angle and an outer right angle sharing a vertex which is parallel the axis, the inner right angle and the outer right angle being opposite angles, and the axis being located within the outer right angle;

the second hinge element including a third plate member, the third plate member being coupled with the body at a location axially overlapping with the first plate member and the second plate member, and having an inboard edge adjoining the body and an outboard edge, the third plate member further including an inner planar face extending from the corresponding inboard edge to the corresponding outboard edge, and an outer planar face extending from the corresponding inboard edge to the corresponding outboard edge;

means for attaching the first hinge element to an exterior surface of a swinging door of a storage device, whereby the first hinge element can interact with the door via the means for attaching and the second hinge element can interact with the body of the storage device via the panel to bias the swinging door toward a closed position.

7. The kit of claim 6 wherein said means for attaching comprises an adhesive material.

8. The kit of claim 7 wherein said means for attaching comprises strips of adhesive tape.

9. The kit of claim 7 further comprising a wear strip configured to provide a protective surface for sliding interaction of said panel against the body of the storage device.

10. The kit of claim 7 wherein said first plate member and said second plate member are disposed normal to one another and configured to mount to first and second perpendicular outer surfaces of a swinging door sharing a common edge.

11. The kit of claim 8 wherein said biasing device is internal of said hinge body.

* * * * *